United States Patent [19]

Swearingen

[11] 4,170,435

[45] Oct. 9, 1979

[54] THRUST CONTROLLED ROTARY APPARATUS

[76] Inventor: Judson S. Swearingen, 2235 Carmelina, Los Angeles, Calif. 90064

[21] Appl. No.: 842,036

[22] Filed: Oct. 14, 1977

[51] Int. Cl.[2] ..... F01D 3/02; F01D 3/00

[52] U.S. Cl. ..... 415/1; 415/106; 415/104

[58] Field of Search ..... 415/110, 111, 112, 104, 415/106, 107, 105

[56] References Cited

U.S. PATENT DOCUMENTS

| | | | |
|---|---|---|---|
| 762,453 | 6/1904 | Sturgeon | 415/107 |
| 887,658 | 5/1908 | Krogh | 415/106 |
| 971,851 | 10/1910 | Krogh | 415/106 |
| 971,852 | 11/1910 | Krogh | 415/106 |
| 976,400 | 11/1910 | Salzer | 415/106 |
| 1,022,425 | 4/1912 | Kuechler | 415/106 |

*Primary Examiner*—Louis J. Casaregola

*Attorney, Agent, or Firm*—Browning, Bushman & Zamecki

[57] ABSTRACT

The invention comprises an improved rotary apparatus comprising an outer body member having an internal generally axially directed first thrust area. An inner body member is mounted within the outer body member for relative rotation of the two body members. The inner body member has a second generally axially directed thrust area generally opposed to the first thrust area. The body members define fluid passageways and the thrust areas define a fluid-receiving space therebetween in communication with the passageways. First and second annular seals of differing diameters seal between the thrust areas, and a thrust control system is provided for selectively varying the fluid pressure in the annular portion of the fluid-receiving space bounded by the two seals by selectively providing pressure equalizing communication between that portion and a plurality of zones of differing pressures external to the annular portion.

24 Claims, 2 Drawing Figures

THRUST CONTROLLED ROTARY APPARATUS

BACKGROUND OF THE INVENTION

1. Field of the Invention

The present invention pertains to rotary machines and particularly to fluid handling apparatus such as, for example, tubo-expanders. Such a machine typically comprises a stationary housing or stator having a rotor mounted therein on a rotary shaft. The stator has an inlet into which a high pressure gas is introduced. This gas passes through the stator to a series of nozzles which direct the gas radially and tangentially toward the rotor, the latter having a series of radially outwardly opening inlets aligned with the stator nozzles. From the rotor inlets, the gas passes through one or more flowways in the rotor and exits through one or more axially opening rotor outlets located radially inwardly of the rotor inlets. The gas expands as it passes through the rotor and, due to the configuration of the stator nozzles and rotor flowways, causes the rotor to rotate in a manner well known in the art.

Other types of fluid handling machines such as radial turbines, centrifigual pumps, centrifugal compressors, and the like have generally similar rotors although in some, e.g. the centrifugal pump, the operation is generally reversed, the axially opening ends of the rotor flowways serving as inlets and the radially opening ends as outlets. In any such device it is customary to employ a seal between the rotor and stator on one or both sides of the radially opening ends of the rotor flowways. Usually some fluid leaks past such seals and, in fact, some of the preferable seals for certain systems are designed to permit a limited amount of leakage. When such leakage is toward the axial openings in the rotor, the effect thereof is minimal since the gas may be entrained in the stream of like gas flowing through the apparatus. However, gas leaking toward the closed end of the rotor enters a space formed between that end and a generally opposed internal axially directed face of the stator. The gas may become trapped in this space thus imposing a thrust load on the rotor and its shaft. Vent means may be provided to alleviate this problem.

2. Description of the Prior Art

In my prior U.S. Pat. No. 3,895,689, issued July 22, 1975, there is disclosed a system for balancing the thrust in a rotary fluid handling apparatus of the type described above. In brief, means are associated with the thrust bearings associated with the rotary shaft to monitor the thrust load thereon. The monitoring system is operatively associated with a valve or the like in the vent line from the area adjacent the closed end of the rotor. Thus the valve may be operated in accord with the readings of the monitoring system to increase or decrease the fluid pressure behind the rotor and therefore balance the thrust thereon. However, the range of thrust loads which may be thus imposed on the back of the rotor is limited to a range bounded by the pressure which would naturally build up behind the rotor without venting and the pressure which exists at the zone of the apparatus to which the area is vented.

SUMMARY OF THE INVENTION

The present invention provides an improved system for thrust control of the aforementioned type of rotary apparatus which may include a more versatile range of applicable thrust values than in the system of U.S. Pat. No. 3,895,689.

In particular, the closed end of the rotor in the present invention and the opposed internal generally axially directed area of the stator form thrust areas between which a fluid-receiving space is defined. First and second annular seals of different diameters seal between the thrust areas and bound a first annular portion of the fluid-receiving space. Thrust control means are provided for selectively varying the fluid pressure in this first portion whereby the thrust on the rotor may be varied.

Preferably, this thrust control means is operative to selectively provide pressure equalizing communication between the first portion of the fluid-receiving space and a plurality of zones of differing pressures external to said first portion. These zones may be various zones of the fluid passageways through the rotor and stator. Where one of these zones is of a pressure higher than the pressure prevailing on the other sides of the aforementioned seals from the first portion of the fluid-receiving space, the fluid introduced into the first portion serves the additional purpose of sweeping dust and other impurities away from the seals as it leaks therethrough.

In a preferred form of the invention, the first seal means is spaced radially inwardly from the radially outer extremities of the aforementioned thrust areas whereby a second portion of the fluid-receiving space is defined radially outwardly of the first seal means. Similarly, the second seal means is spaced radially outwardly from the radially inner extremities of the thrust areas whereby a third portion of the fluid-receiving space is defined radially inwardly of the second seal means. Each of these latter portions may be in pressure equalizing communication with a respective zone of the fluid passageways through the rotor and stator. Due to the differing pressures prevailing at these zones and to the presence of the seals, the three portions of the fluid-receiving space will then ordinarily have different pressures, the pressure of the first portion being intermediate that of the other two portions. Then the thrust control means may comprise conduit means connecting the first portion with respective ones of the other portions and bypassing the respective seals and valve means in the conduit means whereby the first portion may be selectively placed in pressure equalizing communication with either of the other two portions.

The thrust control means may further comprise means for selectively providing pressure equalizing communication between the first portion of the fluid-receiving space and a third zone of the fluid passageway means of even higher pressure than the first two zones. Similarly, means may be provided for allowing pressure equalizing communication between the first portion of the fluid-receiving space and a fourth zone of lower pressure than the other three zones.

Accordingly, it is a principal object of the invention to provide an improved means for controlling the thrust on a rotary apparatus.

Another object of the present invention is to provide a highly versatile and variable thrust control system for varying the fluid pressure behind the rotor of such an apparatus.

Still another object of the present invention is to provide such a system which utilizes for thrust control, fluid from different pressure zones within a fluid handling apparatus.

Yet a further object of the present invention is to provide such a system which may additionally be used to protect seals within the apparatus by sweeping dust and other impurities away from the seals.

Still other objects, features and advantages of the present invention will be made apparent by the following description of the preferred embodiments, the drawings and the claims.

DESCRIPTION OF THE PREFERRED EMBODIMENTS

Figure 1:
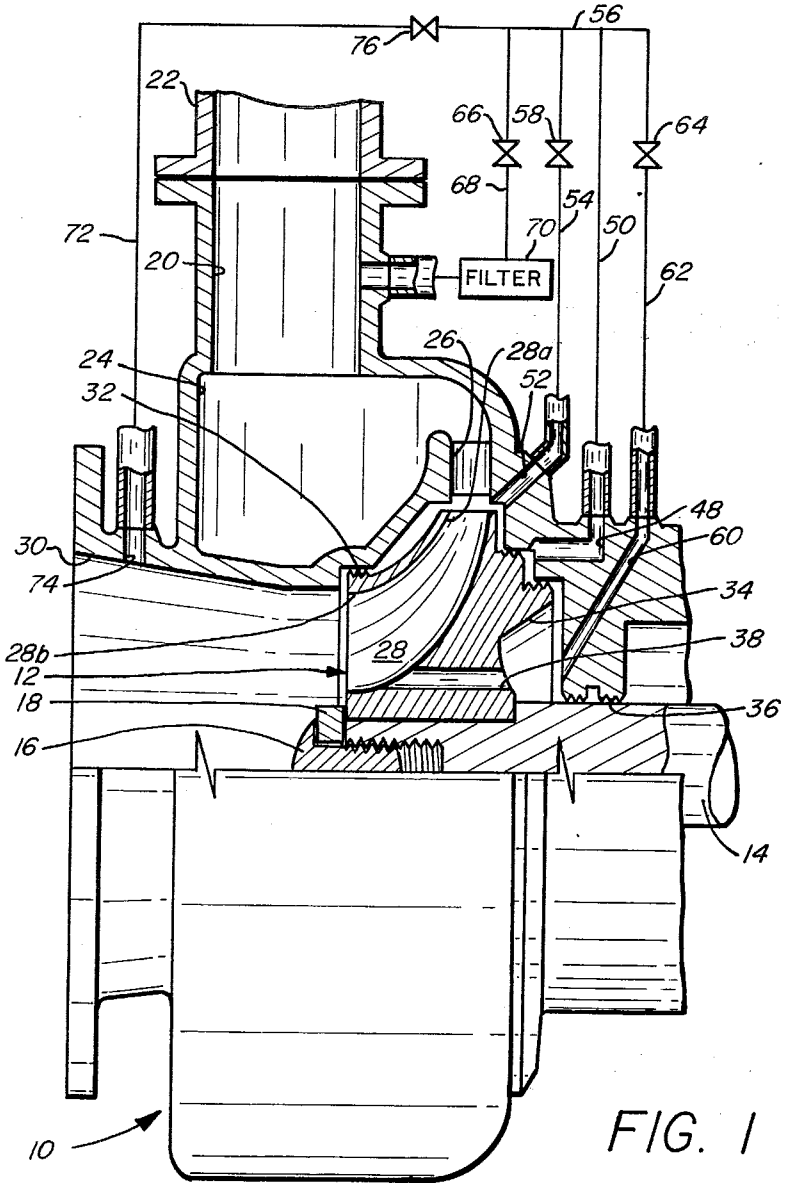
FIG. 1 is a longitudinal quarter-sectional view of a turbo-expander and thrust control system, with portions of the thrust control system being shown diagrammatically.

Referring to FIG. 1, there is shown a fluid handling device in the form of a turbo-expander having a stationary housing or stator 10 and a rotor 12 disposed coaxially within the stator 10. Rotor 12 is secured to a shaft 14 by a bolt 16 and washer 18 for rotation within the stator 10. The shaft 14 extends past the rotor 12 to a bearing structure, including radial and thrust bearings, which may be of the type illustrated in my prior U.S. Pat. No. 3,895,689 or of any other type well known in the art. Likewise, the thrust control system to be described below may be operated either manually or automatically in accord with measurements of the thrust on the thrust bearings of such assembly in a manner disclosed in my aforementioned prior patent.

The stator 10 and rotor 12 define a fluid passageway system through the apparatus. In particular, the stator 10 includes an inlet 20 through which high pressure gas is admitted into the apparatus from a conduit 22 leading to a suitable source of such gas. The inlet 20 leads into an annular stator chamber 24 generally surrounding the open central portion of the stator in which rotor 12 is mounted. The gas from chamber is injected into said central portion and thus into the rotor 12 through a plurality of nozzles 26 circumferentially spaced about the rotor 12.

Rotor 12 has a plurality of flowways 28 therethrough. The flowways 28 have respective inlet ends **28*a* opening generally radially outwardly and disposed in register with the nozzles 26. From its respective inlet 28*a*, each flowway 28 curves radially inwardly and axially to the left, as viewed in FIG. 1, to terminate in a respective outlet end 28*b* located radially inwardly of the inlet ends 28*a* but opening axially into the open central portion of the stator 10. The gas then passes through this central open portion of the stator to one end 30** thereof which serves as an outlet to which a suitable removal conduit (not shown) may be connnected.

The gas which passes through the turbo-expander is at its highest pressure at the inlet 20. As the gas passes through the nozzles 26 the pressure drops somewhat. Although the nozzles 26 open generally radially inwardly toward the registering inlets **28*a* of the rotor 12, they are also tangentially inclined with respect to the rotor. This inclination together with the configuration of flowways 28 and the expansion of the gas as it passes through the flowways 28 serves to impart rotary motion to the rotor 12 and the attached shaft 14 in a manner well known in the art. Consequently, the pressure of the gas at the outlets 28*b* is substantially lower than that at the zone including the outlet ends of nozzles 26 and inlets 28*a*. As the gas passes to the outlet 30 there is a further pressure drop, so that the lowest gas pressure exits at the outlet 30**.

Since it is necessary to provide some clearance between the rotor and stator, some of the fluid exiting the nozzles 26 will pass into this clearance space (which may be considered a part of the passageways defined by the rotor and stator) rather than into the rotor flowways 28. To control the flow of this fluid, an annular rotary seal 32 is provided between the rotor and stator. The rotor 12 may be considered as having a front or open end, i.e. the end including the outlets **28*b*, the opposite end being considered the back or closed end of the rotor. Seal 32 is disposed on the side of inlets 28*a* toward the open end of the rotor. While the seal 32 as shown is of the labyrinth type, numerous other types of rotary seals may be employed. In any event, some leakage of fluid past seal 32 is probable and indeed sometimes desirable. Fluid so leaking will pass into the area adjacent the outlets 28*b*** and will simply be entrained in the stream of fluid exiting the apparatus.

A similar seal may be employed on the other side of inlets **28*a*, i.e on the side toward the closed end of the rotor 12. However, since this end of the rotor is essentially closed, and since the shaft 14 is sealed to the stator 10 at 36, fluid leaking past this latter seal may build up in the space 34 behind the rotor and impose an undesired thrust load thereon. To alleviate this fluid pressure build-up, one or more vent bores 38 are provided through the rotor 12. Each bore 38 extends from the space 34 behind the rotor 12 to a zone of one of the flowways 28 which is adjacent the respective flowway outlet 28*b*. As mentioned above, the pressure prevailing near these outlets 28*b* is relatively low, so that high pressure fluid in space 34 will naturally be vented from this latter area by the bores 38**.

However, whereas in prior art devices, vent bores such as 38 merely served as passive means to reduce pressure build-up, the present invention actively utilizes fluid pressure within space 34 as well as pressures prevailing in various zones of the passageways through the rotor and stator to actively control the thrust load on the rotor 12 and its attached shaft 14.

Figure 2:
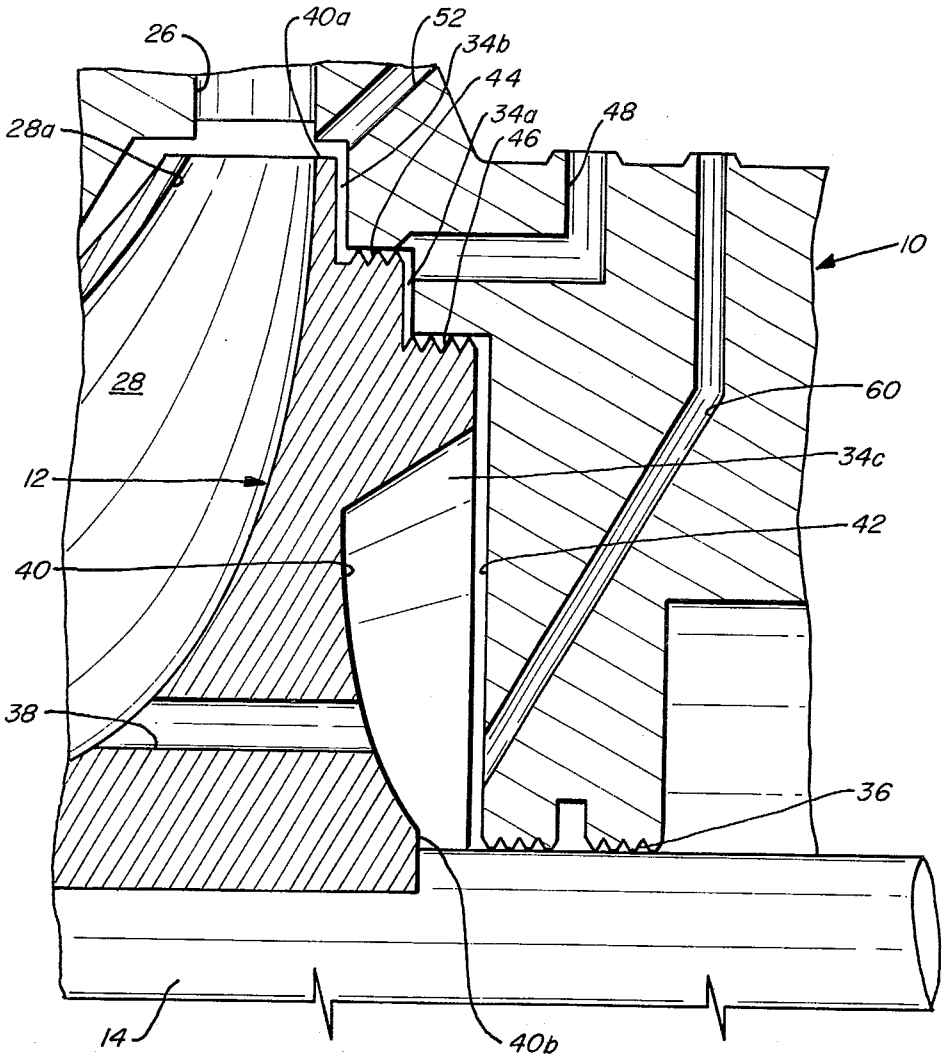
FIG. 2 is an enlarged detailed sectional view of a portion of the apparatus shown in FIG. 1.

Referring now to FIG. 2 in conjunction with FIG. 1, the area surrounding the closed end of the rotor 12 is shown in greater detail. The area of the back or closed end of the rotor 12 extending from the outer diameter at **40*a* adjacent the inlets 28*a* to the intersection 40*b* with shaft 14 forms a generally axially directed thrust area 40. By this is meant that over the annular area between 40*a* and 40*b* there are, with the exception of the relatively small openings of bores 38, surfaces which, while they may be curved or inclined, face at least partially in an axial direction so that they are capable of reacting against an axially directed force thereon. Similarly, stator 10 defines an opposing internal thrust area 42. The aforementioned fluid-receiving space 34 is defined between areas 40 and 42**.

As shown, the outer part of thrust area 42 has two counterbores and thrust area 40 has a generally mating stepped configuration. At the first counterbore there is provided a first annular labyrinth seal 44 which seals between the rotor 12 and stator 10. A second annular labyrinth seal 46 is formed at the second counterbore. The first seal 44 is spaced radially inwardly from the radially outer extremities of the thrust areas 40 and 42, and the second seal 46 is spaced radially outwardly from the radially inner extremities of the thrust areas. Thus the seals 44 and 46 divide the fluid-receiving space 34 into three coaxial annular portions: a first or middle portion 34*a* between the two seals, a second or outer portion 34*b* located radially outwardly of seal 44, and a third or inner portion 34*c* located radially radially inwardly of seal 46.

It can be seen that portion 34*b* of the fluid-receiving space is in pressure equalizing communication, specifically open fluid communication, with the relatively high pressure zone of the turbo-expander passageways including the outlet ends of nozzles 26. Portion 34*c* of the fluid-receiving space is in pressure equalizing communication with a lower pressure zone of the turbo-expander passageways, namely the zone adjacent and including the rotor outlets 28*b*, via bore or bores 38. Since seals 44 and 46 are of a type which permit some leakage therepast, the pressure of fluid in portion 34*a* of the fluid-receiving space will ordinarily be intermediate those of portions 34*b* and 34*c*. Furthermore, it can be seen that the thrust force imposed on the rotor 12 by the fluid in any one of the portions of the fluid-receiving space will be the product of the pressure within that portion and the annular area defined by the radially inner and outer extremities of that portion. For example, the force exerted by the fluid in portion 34*a* will be the pressure of the fluid in portion 34*a* times the annular area between seals 44 and 46. Thus the total force imposed on the rotor by the fluid in space 34 will be the sum of the forces exerted in the various portions of space 34.

A bore 48 in stator 10 has its inner end in open fluid communication with portion 34*a* of space 34 and its outer end in communication with a line 50. Together, bore 48 and line 50 provide a conduit through which various pressure zones of the turbo-expander passageways may be placed in pressure equalizing communication with portion 34*a* to vary the thrust force imposed by the fluid in that portion of the fluid-receiving space 34. As mentioned above, two such zones are already in fluid communication with the other two portions, 34*b* and 34*c* respectively, of space 34. Thus it is particularly convenient to provide for communication between portion 34*a* and these two pressure zones via portions 34*b* and 34*c*.

Accordingly, a bore 52 is provided in stator 10 with one end in open communication with portion 34*b* of space 34 and the other end in communication with a line 54. Lines 50 and 54 are interconnected by a line 56. Thus bore 52, lines 54, 56 and 50, and bore 48 form a by-pass around seal 44. A valve 58 is disposed in line 54 so that this by-pass may be selectively opened and closed. When valve 58 is opened, portions 34*a* and 34*b* of the space 34 are in pressure equalizing communication, specifically open fluid communication. As mentioned above, the pressure ordinarily prevailing in portion 34*b* is higher than that ordinarily prevailing in portion 34*a*, in particular being equal to that in the zone of the turbo-expander passageways including the outlet ends of nozzles 26. Thus opening the valve 58 has the effect of raising the pressure within portion 34*a* to that prevailing at the outlet ends of nozzles 26 and thereby increasing the thrust load on the rotor 12 acting to urge it to the left as viewed in the drawings.

A similar by-pass is provided around seal 46 by a bore 60 communicating with portion 34*c* of space 34 and with a line 62 which is in turn connected to line 56 and thence to line 50 and bore 48. A valve 64 is provided in line 62. As mentioned, the pressure ordinarily prevailing in portion 34*c*, i.e. with all valves closed, is less than that in portion 34*a*, and in particular is equal to that in a relatively low pressure zone of the turbo-expander passageways including rotor outlets 28*b*. By opening valve 64, portions 34*a* and 34*c* of the fluid-receiving space are placed in pressure equalizing communication, the pressure of portion 34*a* being lowered to that of the rotor outlets 38*b*, and the thrust load is consequently reduced.

If it is desired to increase the thrust on the rotor 12 even more than is possible by opening valve 58, this may be done by opening a valve 66 in a line 68 leading from the stator inlet 30 to the line 56 and thence to line 50 and bore 48. As mentioned above, inlet 20 is the zone of highest pressure in the turbo-expander. Thus opening valve 66 provides for a very large increase in the pressure in portion 34*a* and a correspondingly large increase in the thrust on the rotor.

Another salient effect of opening valve 66 is that, since the pressure in inlet 20 is higher than those prevailing in either of portions 34*b* or 34*c*, the fluid introduced into portion 34*a* by the opening of valve 66 will leak past both seals 44 and 46 tending to sweep dust and other impurities away from the seals and thereby reduce seal wear. Thus, over and above any need to increase the thrust load on the rotor 12, valve 66 may be periodically opened to clean the seals 44 and 46. In accord with this seal-cleaning function, it is desirable that the fluid entering portion 34*a* from line 68 itself be as free from impurities as practical. Therefore a suitable filter 70 is placed in line 68 to remove dust and the like.

In this connection it is also noteworthy that, when valve 58 is opened as described above, the pressure admitted to portion 34*a* will be greater than that in portion 34*c* and equal to that in portion 34*b*. Thus the fluid in portion 34*a* will actively sweep dust and other impurities away from seal 46. While such fluid will not actively sweep dust away from seal 44, it will at least offset any tendency of such impurities to sweep through the latter seal from portion 34*b* and will thus still have a protective effect on both seals.

Finally, it may at times be desirable to reduce the thrust on rotor 12 by a value which is even lower than that achieved by opening valve 64. For this purpose, a line 72 is provided communicating with line 56 and with a bore 74 into the stator outlet 30. Stator outlet 30 is in the zone of lowest pressure in the turbo-expander. Thus by opening a valve 76 in line 56 intermediate lines 72 and 50, portion 34*a* is placed in pressure equalizing communication with outlet 30 thereby greatly reducing the thrust.

The thrust can thus be adjusted through a series of steps or increments in a relatively wide range as follows: a lowermost thrust may be imposed by opening valve 76 and closing all other valves; a slightly higher thrust may be imposed by opening only valve 64; an intermediate or normal thrust may be provided by closing all valves; a higher thrust may be provided by opening only valve 58; and a highest thrust may be provided by opening only valve 66. Furthermore, by proper throttling devices associated with each of the above valves, it is possible to provide further continuity of the adjustments over the total range, i.e. to provide in effect an infinite number of increments.

It can thus be seen that the system of the present invention provides a precise and highly versatile means of controlling the thrust on a rotary fluid handling device. The system conveniently makes use of the pressures prevailing at various pressure zones of the device itself to accomplish such control. Furthermore, the system provides a means for cleaning and/or preventing wear of seals.

It will also be appreciated the numerous modifications of the preferred embodiment described above may be made without departing from the spirit of the invention. By way of example only, as mentioned above, seals other than the labyrinth type can be employed. Furthermore, any flow restriction or other means sufficient to provide a substantial pressure drop thereacross will be considered a "seal" for purposes of this application, and in particular, a simple restriction may be employed in place of the labyrinth seal at 36.

Also, in the embodiment shown, the seals 44 and 46 which bound the pressure-variable thrust control portion of the fluid-receiving space behind the rotor are spaced from the radial extremities of the thrust areas so that the fluid-receiving space is divided into three portions, the intermediate one being the pressure-variable one. However, in other embodiments, the outermost seal 44 may be placed at the outer extremity of the thrust areas so that the space is divided into two sealed portions. In another modification, seal 44 might be eliminated altogether. Then the fluid-receiving space would again be divided into two portions, the outer one being unsealed at its outer extremity, except for such rotary fluid vortex as may exist therein, and the inner one, bounded by first and second seals 46 and 36, respectively, could be the pressure-variable portion if bores 38 were restricted or eliminated.

It is also noted that the type of pressure-equalizing communication provided between various areas in the embodiment described is open fluid communication. However, in other embodiments it might be possible at some points in the system to provide pressure equalizing communication without fluid communication, as by the use diaphragms.

While the invention has been described in connection with a turbo-expander, it can be advantageously used with other types of fluid-handling devices such as turbines of various kinds, compressors, centrifugal pumps, etc. Also, the invention can be employed in devices in which the outer member is rotary and the inner member is stationary. Furthermore, the invention may be applied to rotary devices in which no fluid passes through the rotor. For example, the invention may be advantageously used with a rotary balancing drum sealed with respect to the surrounding housing. Accordingly, the "passageways" defined by the rotary and stationary members are not limited to openings intended to provide for substantial fluid flow, but may be any openings defined by said members, such as the clearance between the members, and in which fluid will be present.

Finally, while the fluid passageways defined by the rotary and stationary members provide convenient zones of differing pressures to be selectively communicated with the sealed thrust control portion of the area behind the rotor, it is possible to utilize other sources for such pressure zones. In particular, suitable pressure zones may be found elsewhere in the plant in which the apparatus is incorporated.

It is thus intended that the scope of the present invention be limited only by the claims which follow.

I claim:

1. Rotary apparatus comprising:

an outer body member having an internal generally axially directed first thrust area;

an inner body member mounted at least partially within said outer body member for relative rotation of said body members and having a second generally axially directed thrust area generally opposed to said first thrust area;

wherein said body members define fluid passageway means and said thrust areas define a fluid-receiving space therebetween in communication with said passageway means;

first annular seal means sealing between said thrust areas;

second annular seal means of lesser diameter than said first seal means and also sealing between said thrust areas, whereby an annular first portion of said fluid-receiving space is defined between said two seal means;

said apparatus defining two gaps located respectively an opposite sides of said first and second seal means from said first portion of said fluid-receiving space, and said gaps each communicating with a respective one of two zones of differing pressure external to said first portion;

and thrust control means for selectively varying the fluid pressure in said first portion of said fluid-receiving space, said thrust control means including means for selectively providing pressuring equalizing communication between said first portion and said two gaps.

2. Rotary apparatus as defined in claim 1 wherein one of said gaps comprises a second portion of said fluid-receiving space radially offset from said first portion and communicating with said fluid passageway means, and wherein said thrust control means includes means for selectively providing pressure equalizing communication between said first and second portions of said fluid-receiving space.

3. Rotary apparatus as defined in claim 1 wherein said first seal means is spaced radially inwardly from the radially outer extremities of said thrust areas whereby a second portion of said fluid-receiving space is defined radially outwardly of said first seal means and comprising one of said two gaps, wherein said second seal means is spaced radially outwardly from the radially inner extremities of said thrust areas whereby a third portion of said fluid-receiving space is defined radially inwardly of said second seal means and comprising the other of said two gaps, wherein said fluid passageway means includes first and second zones of differing pressures communicating with respective ones of said second and third portions of said fluid-receiving space, and wherein said thrust control means includes means for selectively providing pressure equalizing communication between said first portion and at least one of said second and third portions.

4. Rotary apparatus as defined in claim 3 wherein said thrust control means includes conduit means connecting said first portion and said one portion and bypassing the intermediate one of said seals; and means for selectively opening and closing said conduit means.

5. Rotary apparatus as defined in claim 3 wherein said thrust control means includes means for selectively providing pressure equalizing communication between said first portion and the other of said second and third portions.

6. Rotary apparatus as defined in claim 5 wherein said fluid passageway means includes a third zone of different pressure than either of said first and second zones, and wherein said thrust control means further includes means for selectively providing pressure equalizing communication between said third zone of said fluid passageway means and said first portion of said fluid-receiving space.

7. Rotary apparatus as defined in claim 6 wherein said third zone is of a pressure higher than either of said first and second zones, wherein said fluid passageway means includes a fourth zone of pressure lower than any of said first, second and third zones, and wherein said thrust control means further includes means for selectively providing pressure equalizing communciation between said fourth zone and said first portion of said fluid-receiving space.

8. Rotary apparatus as defined in claim 7 being a turbo-expander, said inner body member being a rotor having fluid flowway means therethrough, said flowway means including generally radially outwardly opening inlet means and generally axially opening outlet means spaced radially inwardly from said inlet means, said outer body member being a stator having inlet means and further having injection means directed into said inlet means of said rotor, and wherein said first zone of said fluid passageway means includes said injection means and communicates with said second portion of said fluid-receiving space, and said second zone of said fluid passageway means includes said outlet means of said rotor and communicates with said third portion of said fluid-receiving space.

9. Rotary apparatus as defined in claim 8 wherein said third zone of said fluid passageway means includes said inlet means of said stator.

10. Rotary apparatus as defined in claim 9 wherein said stator further comprises outlet means adjacent to and communicating with said outlet means of said rotor, and wherein said fourth zone of said fluid passageway means includes said outlet means of said stator.

11. Rotary apparatus as defined in claim 1 comprising means for introducing into said first portion of said fluid-receiving space, fluid of a pressure at least as high as the pressures prevailing on the other sides of said seal means from said first portion.

12. Rotary apparatus as defined in claim 11 wherein said fluid is introduced from a high pressure zone of said fluid passageway means.

13. Rotary apparatus as defined in claim 12 further comprising filter means interposed between said high pressure zone and said first portion of said fluid-receiving space.

14. Rotary apparatus as defined in claim 1 wherein said thrust control means is operative to selectively provide pressure equalizing communication between said first portion of said fluid-receiving space and a plurality of zones of said fluid passageway means, said zones being of differing pressures.

15. Rotary apparatus comprising:

an outer body member having an internal generally axially directed first thrust area;

an inner body member mounted at least partially within said outer body member for relative rotation of said body members and having a second generally axially directed thrust area generally opposed to said first thrust area;

wherein said body members define fluid passageway means and said thrust areas define a fluid-receiving space therebetween in communication with said passageway means;

first annular seal means sealing between said thrust areas radially inwardly from the radially outer extremities of said thrust areas;

second annular seal means of lesser diameter than said first seal means sealing between said thrust areas radially inwardly of said first seal means but radially outwardly from the radially inner extremities of said thrust areas, whereby said fluid-receiving space is divided into co-axial inner, outer, and mid portions by said first and second seal means;

and wherein said outer body member has three bores therethrough, each of said bores communicating with a respective one of said three portions of said fluid-receiving space, whereby said apparatus may be adapted for communication of said mid portion of said fluid-receiving space with either said inner or said outer portion by interconnecting the respective ones of said bores.

16. The apparatus of claim 15 wherein said inner body member is a rotor having fluid flowway means therethrough, said rotor also having vent means therethrough providing communication between the said flowway means and one of said portions of said fluid-receiving space.

17. The apparatus of claim 16 being a turbo-expander, said flowway means of said rotor including generally radially outwardly opening inlet means and generally axially opening outlet means spaced radially inwardly from said inlet means, said vent means providing communication between said outlet means and said inner one of said portions of said fluid-receiving space.

18. A method of controlling thrust on a rotary apparatus of the type comprising an outer body member having an internal generally axially directed first thrust area, an inner body member mounted at least partially within said outer body member for relative rotation of said body members and having a second generally axially directed thrust area generally opposed to said first thrust area, and wherein said body members define fluid passageway means and said thrust areas define a fluid-receiving space therebetween in communication with said passageway means, comprising:

providing first annular seal means sealing between said thrust areas;

providing second annular seal means of lesser diameter than said first seal means and also sealing between said thrust areas;

and selectively varying the fluid pressure in an annular first portion of said fluid-receiving space bounded by said two seal means, by selectively providing pressure equalizing communication between said first portion of said fluid-receiving space and a second portion of said fluid-receiving space, said second portion being radially offset from said first portion and in communication with said fluid passageway means.

19. The method of claim 18 wherein said first seal means is spaced radially inwardly from the outer extremities of said thrust area whereby said second portion of said fluid-receiving space is defined radially outwardly of said first seal means, wherein said second seal means is spaced radially outwardly from the radially inner extremities of said thrust area whereby a third portion of said fluid-receiving space is defined radially inwardly of said second seal means, wherein said fluid passageway includes first and second zones of different pressures communicating with respective ones of said second and third portions of said fluid-receiving space, and wherein said selective variation of said fluid pressure includes selectively providing pressure equalizing communication between said first portion and said third portion of said fluid-receiving space.

20. The method of claim 19 wherein said fluid passageway means includes a third zone of pressure higher than either of said first and second zones and a fourth zone of pressure lower than any of said first, second and third zones, and wherein said variation of fluid pressure further comprises selectively providing pressure equalizing communication between said first portion of said fluid-receiving space and said third and fourth zones.

21. The method of claim 20 wherein said pressure equalizing communication is provided by providing open fluid communication between said first portion of said fluid-receiving space and said first second, third and fourth zones.

22. The method of claim 18 wherein said pressure equalizing communication is provided by providing open fluid communication between said first and second portions of said fluid-receiving space.

23. The method of claim 18 comprising introducing into said first portion of said fluid-receiving space fluid of a pressure at least as high as the pressures prevailing on the other side of said seal means from said first portion.

24. The method of claim 23 wherein fluid is introduced from a high pressure zone of said fluid passageway means.

* * * * *

UNITED STATES PATENT AND TRADEMARK OFFICE

CERTIFICATE OF CORRECTION

PATENT NO. : 4,170,435

DATED : October 9, 1979

INVENTOR(S) : Judson S. Swearingen

It is certified that error appears in the above-identified patent and that said Letters Patent are hereby corrected as shown below:

In Claim 1, Column 8, line 20, before the word opposite, delete the word "an", and insert therefor --on--.

In Claim 7, Column 9, line 13, delete the word "communciation", and insert therefor --communication--.

In Claim 15, Column 10, line 13, after the word said, delete the word "three."

Signed and Sealed this

*Second* Day of *June 1981*

[SEAL]

*Attest:*

RENE D. TEGTMEYER

*Attesting Officer*

*Acting Commissioner of Patents and Trademarks*